United States Patent [19]

Müller et al.

[11] Patent Number: 5,068,066

[45] Date of Patent: Nov. 26, 1991

[54] PROCESS AND APPARATUS FOR PRODUCING PROPELLANT CHARGE GRANULAR MATERIAL

[75] Inventors: Dietmar Müller, Karlsruhe; Helmut Bauer, Malgersdorf, both of Fed. Rep. of Germany

[73] Assignee: Fraunhofer-Gesellschaft zur Forderung der angewandten Forschung e.V., Munich, Fed. Rep. of Germany

[21] Appl. No.: 310,919

[22] Filed: Feb. 16, 1989

[30] Foreign Application Priority Data

Feb. 20, 1988 [DE] Fed. Rep. of Germany ..... 3805317

[51] Int. Cl.[5] ..... C06B 21/00

[52] U.S. Cl. ..... 264/3.3

[58] Field of Search ..... 264/3.3

[56] References Cited

U.S. PATENT DOCUMENTS

| | | | |
|---|---|---|---|
| 3,969,054 | 7/1976 | Roane | 425/142 |
| 4,585,600 | 4/1986 | Rollyson et al. | 264/3.3 |
| 4,660,475 | 4/1987 | Rogowski et al. | 102/284 |
| 4,931,229 | 6/1990 | Krimmel et al. | 264/3.3 |

*Primary Examiner*—Peter A. Nelson

*Attorney, Agent, or Firm*—Antonelli, Terry, Stout & Kraus

[57] ABSTRACT

For producing propellant charge granular material several small diameter propellant charge strands are continuously extruded, individually placed on a support behind the extruder and conveyed over a setting zone. The strands are subsequently supplied on a sloping zone to a cutting plate with a number of guide holes corresponding to the number of strands. On passing out of the guide holes the strands are cut to the desired length by cutting blades rotating being the cutting plate.

8 Claims, 5 Drawing Sheets

PROCESS AND APPARATUS FOR PRODUCING PROPELLANT CHARGE GRANULAR MATERIAL

BACKGROUND OF THE INVENTION

The invention relates to a process and apparatus for producing a propellant charge of granular material from small diameter propellant charge strands, whereof a plurality of strands are continuously extruded and cut to short lengths by rotating cutting blades.

Monobasic propellant charge powders, comprising nitrocellulose, optionally accompanied by the addition of dinitrotoluene, dibasic propellant charge powders, which can additionally contain nitroglycerin and/or diglycoldinitrate, and tribasic propellant charge powders additionally containing nitroguanidine, in the case of corresponding process parameters can be continuously processed to propellant charge strands in an extruder (DE-AL 30 44 577). Nitrocellulose serves as the binder and, besides the same or in addition hereto, also plastic binders.

The throughput of an extruder is between 80 and 100 kg/h. With such a throughput, in order to produce small diameter, e.g. between 0.5 and 4 mm propellant charge strands, the extruder has shaping heads with up to 100 orifices. It is possible for the purpose of producing a granular material from such propellant charge strands to use so-called die face granulators, which comprise a rotor with several cutting blades rotating in front of the shaping head and separate from the strands members having a short cut length.

It has been found that when using such a die face granulator the cut length varies within wide ranges and a non-uniform granular material is obtained, which is highly undesirable of the use of the latter. For example, in the case of a calibre of 7.62, a diameter of 0.8 to 1 mm for a cut length os 1.3 mm must be ensured. It must also be borne in mind that the propellant strand or the individual propellant members still have a central channel for burn-off reasons and this should not be deformed during cutting. The lack of uniformity of the granular material also results from the fact that straight cuts cannot be obtained and the individual propellant members are deformed. The reason for this is that the propellant strand, on leaving the shaping head, is still plastic and therefore sensitive to external force action.

It is also not possible to use the known principle of a jointly rotating cutting blade in the manner of flying shears, because this would only make it possible to process individual or a few strands. Thus, and due to the kinematics of such cutting blades, it is not possible to achieve a cutting capacity adapted to a high extruder throughput capacity.

The aim underlying the present invention essentially resides in providing is a process and an apparatus which, in the case of high capacity, permits the production of a uniform granular material with close tolerances.

On the basis of the aforementioned process, the present invention solves the problem of the prior art in that the support or base forms a setting zone for the propellant strands and the latter pass from the support or base is a sloping zone and on the latter are supplied to the cutting plate with a number of guide holes corresponding to the number of stands and on passing out of the guide holes, are simultaneously cut to the desired short length by the cutting blades rotating behind the cutting plate.

In the process according to the invention the propellant strands are separated behind the extruder and cut to length on a support or base. On the support, the strand passes through a setting zone, where it acquires an adequate dimensional stability. By the support which exerts no forces on the propellant strands, the latter pass onto the sloping zone on which, under their own weight, i.e. once again without any external force action by conveying means or the like reach the cutting plate and pass into the guide holes thereof. The strands are cut to the desired length at the opposite outlet point, it being possible to adjust the cut length by the rotational speed of the cutting blades. As a result of the careful conveying of the strands, the latter remain true to size and on reaching the cutting blades have a dimensional stability which, in the case of high rotational speed of the cutting blades, leads to a clean and in particular straight cut. Provided that there is a constant, high rotational speed of the cutting blades, the good dimensional stability also leads to a closely toleranced cut length on all the strands.

In a preferred variant of the inventive process the propellant strands are cut to desired strand portions after leaving the extruder and the length thereof is a multiple of the desired cut length.

As a result of this construction the granulation process is separated from strand production in the extruder, so that it is in particular possible to operate behind the extruder with higher conveying and cutting speeds than the discharge speed on the extruder. It is also possible to better control at high processing speeds a strand portion, which can e.g. have a length up to 1.5 m.

In order to supply all the strand portions to the cutting blades at a constant speed, independently of the movement behavior thereof on the sloping zone, it is also possible for the strand portions to be introduced at the end of the sloping zone into the guide holes of the cutting plate by frictional forces acting in a substantially axially parallel manner on a circumference thereof.

For performing the present process, the invention is based on an apparatus with an extruder producing a plurality of continuous small diameter propellant charge strands and rotating cutting blades, which simultaneously cut all the strands to a short granular material length. According to the invention this apparatus is characterized in that behind the support or base is located a guide for each propellant strand with a gradient permitting its further movement under its own weight and that at the end of the guides is positioned the cutting plate with a number of guide holes corresponding to the number of guides and behind which rotate the cutting blades moving past the guide holes at a distance therefrom and simultaneously cutting all the propellant strands to granular material length. Preferably, a separating device for producing strand portions is located above the substrate close to the feed-in end.

Practical tests have revealed that when using such an apparatus it is possible to process propellant charge strands in the diameter range 0.5 to 4 mm to a cut length of 1 to 5 mm and with a high capacity. Conveying speeds up to 1 m/s can be achieved without any problem. The capacity limit is decisively determined by the ignition temperature of the propellant powder, which is above 180° C. Account must be taken of this by the rotational speeds of the cutting blades, their geometrical shape and the material (rapid heat removal during rotation). In this connection it is of particular significance within the scope of the guide holes and, consequently, there is no metallic contact between the cutting plate and the blades, which could lead to uncontrollable heating. However, this means that the strand is not guided at the cutting point and could escape the blade. To avoid this, the cutting blades must rotate at high speed, which must exceed 200 m/s.

According to an advantageous constructional variant, the support is a rotating conveyor, which is provided with a number of receptacles extending in the conveying direction which corresponds to the number of propellant charge strands and provided for in each case one strand portion. The conveyor is e.g. a conveyor belt with grooves running in the conveying direction and which in each case receive a propellant strand or a strand portion.

In a further advantageous variant of the invention the guides connected to the support are constructed as channels or tubes, which pass with a gradient to the cutting plate positioned below the substrate. Behind the guides and in front of the cutting plate with the guide holes can be arranged in pairs rotating friction members, which in each case receive them a strand portion and introduce the same into a guide hole on the cutting plate. The friction members are preferably constructed as rotating brushes.

Rotating brushes have the advantage that they only exert on the strand portion frictional forces substantially only acting in an axially parallel manner and namely each individual bristle only in a linear form, so that compressive forces are avoided as a result of the elastic giving way of the bristles. It is simultaneously ensured that all the strand portions are supplied to the blades at the same speed of advance.

In place of rotating brushes, it is also possible to use tubular rollers or the like, which are optionally filled with a pressure medium, but can be easily deformed.

To avoid a lateral giving way of the strand portions, the latter are guided between the guides and the cutting plate, in particular on either side of the friction members acting diametrically thereon, on linear contact faces, e.g. in prisms.

In order to be able to process a maximum number of strands, the guide holes in the cutting plate are arranged on one or more concentric circles. However, preferably, the guide holes are arranged in groups on a line running in accordance with a secant of a circle, so that the cutting edge of an individual cutting blade successively cuts to size the individual strands of a group and therefore on the one hand uniformly loads the blade drive and on the other uniform wear takes place to the blade.

According to a preferred embodiment with each group of guide holes is associated a group of in each case pairwise arranged, rotating brushes constituting friction members and which are synchronously driven.

It is possible to simultaneously process approximately 100 propellant powder strands at a speed of approximately 1 m/s to granular material.

Appropriately the cutting blades are arranged on the circumference of a rotor, the construction preferably being such that the cutting plate forms the closure of a collecting container can be raised form the cutting plate. The granular material drops directly behind the cutting plate into the collecting container and can be removed wither continuously or intermittently by means of an outlet. In order to be able to replace the blades on the rotor, the container can be raised from the fixed cutting plate. The collecting container simultaneously forms a safety protection for the rotor.

Further details and advantages of the invention can be gathered from the following description of a preferred embodiment of the apparatus with reference to the drawings.

DETAILED DESCRIPTION

Figure 1:
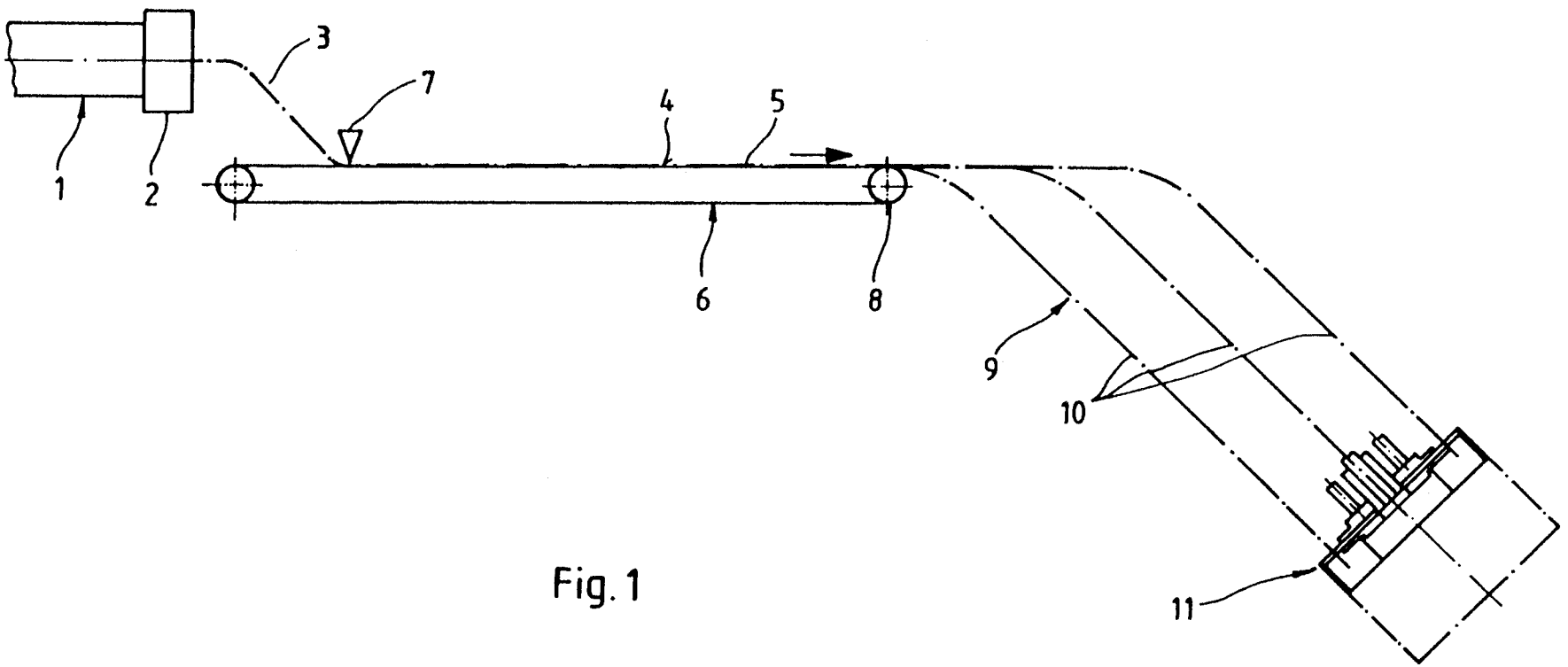
FIG. 1 a diagrammatic flow diagram of an apparatus for producing propellant powder granular material.

FIG. 1 shows an extruder for processing monobasic, dibasic or tribasic propellant powders, which is provided at the end of the mixing and kneading zone with a shaping head 2 for producing propellant charge strands. The shaping head 2 is constructed in such a way that simultaneously a plurality of parallel propellant strands is produced, which are advantageously juxtaposed and this can e.g. be achieved with a flat die-like shaping head.

The propellant strands 3 leaving the extruder pass onto a support or base 4, which is formed by the upper side 5 of a revolving conveyor belt 6, which travels in the direction of the arrow and receives the individual strands 3 in each case one receptacle, e.g. in grooves running in the conveying direction. In this way, the still soft plastic propellant strands are carefully transferred and conveyed. In the illustrated embodiment, in the vicinity of the feed end of conveyor 6 is arranged a separating device 7, which cuts to desired strand portion lengths the propellant strands 3. The strand portions can have a length of approximately 1 meter. The strand portions located in the grooves of the conveyor belt 6 pass, behind the discharge end 8 of conveyor 6, onto a sloping zone 9 on which they substantially advance under their own weight. On the sloping zone 9 are arranged a plurality of guides 10, e.g. in the form of strands or tubes corresponding to the number of strand portions and which supply the latter to the actual granulator 11.

Figure 2:
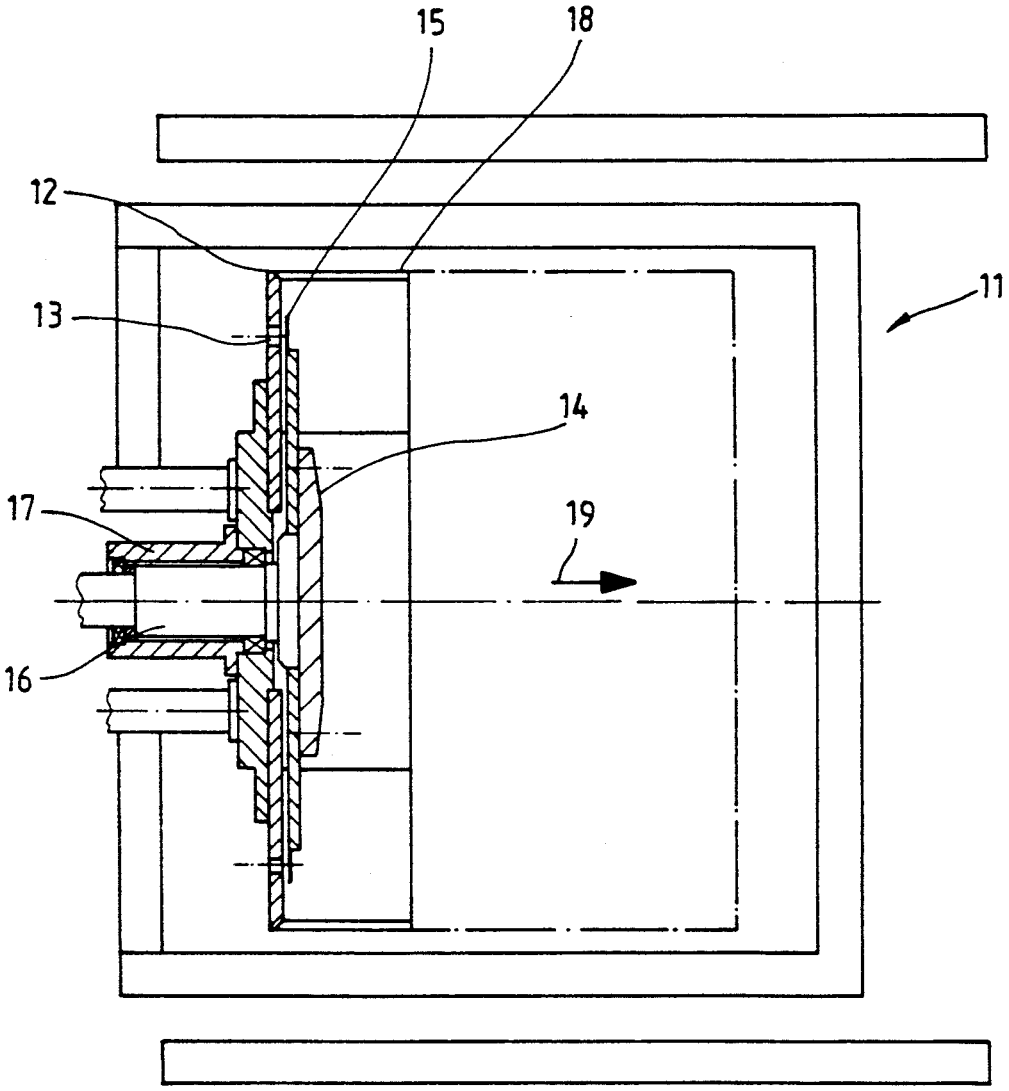
FIG. 2 a diagrammatic side view of the cutting plate with the cutting rotor and the collecting container.

In the illustrated embodiment, as shown most clearly in FIG. 2 the granulator 11 has a fixed cutting plate 12, which carries a plurality of guide holes 13, which are connected in aligned manner to the sloping zone guides 10. Behind the cutting plate 12 is provided a rotor 14, which is circumferentially provided level with the guide holes 13 with a plurality of cutting blades 15, which pass at high speed behind and at a distance from the cutting plate 12. Behind cutting plate 12 is positioned a collecting container 18, whose open end face is closed by the cutting plate 12. Collecting container 18 is displaceable in the direction of arrow 19 and can in this way be raised from the cutting plate 12.

The strand portions supplied by guides 10 to the guide holes 13 are cut to short propellant charge members, which drop into the collecting container 18, by the blades 15 of the rotating rotor. Said container can be continuously emptied by a discharge opening (not shown) as a result of the sloping position shown in FIG. 1.

Figure 3:
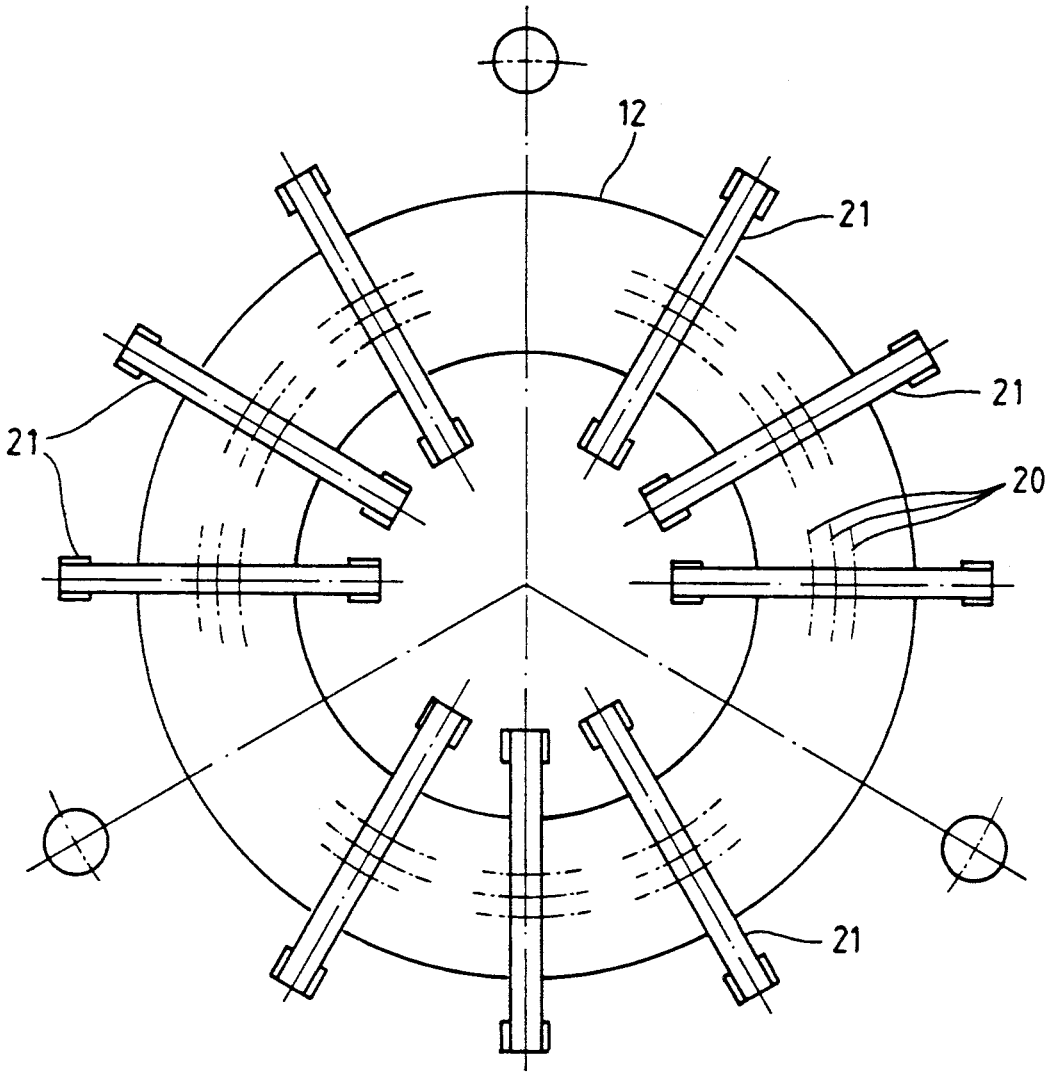
FIG. 3 a front view of the cutting plate.

Advantageously, pairs of rotating friction members are arranged between the guides positioned on the sloping zone 9 and the cutting plate 12. These friction members act diametrically on the strand portions and supply them at a constant speed to the cutting plate 12. In FIG. 3, which is a front view of another embodiment of the cutting plate 12, several guide holes are combined into in each case one group and each group of guide holes is arranged on a line corresponding to a circular secant 20. As can be gathered from FIG. 3, in each case three groups of circular secants are provided, which have different radial spacings from the center of the cutting plate. With each of these three groups is associated a drive unit 21, which in turn drives the friction members for all three groups.

Figure 4:
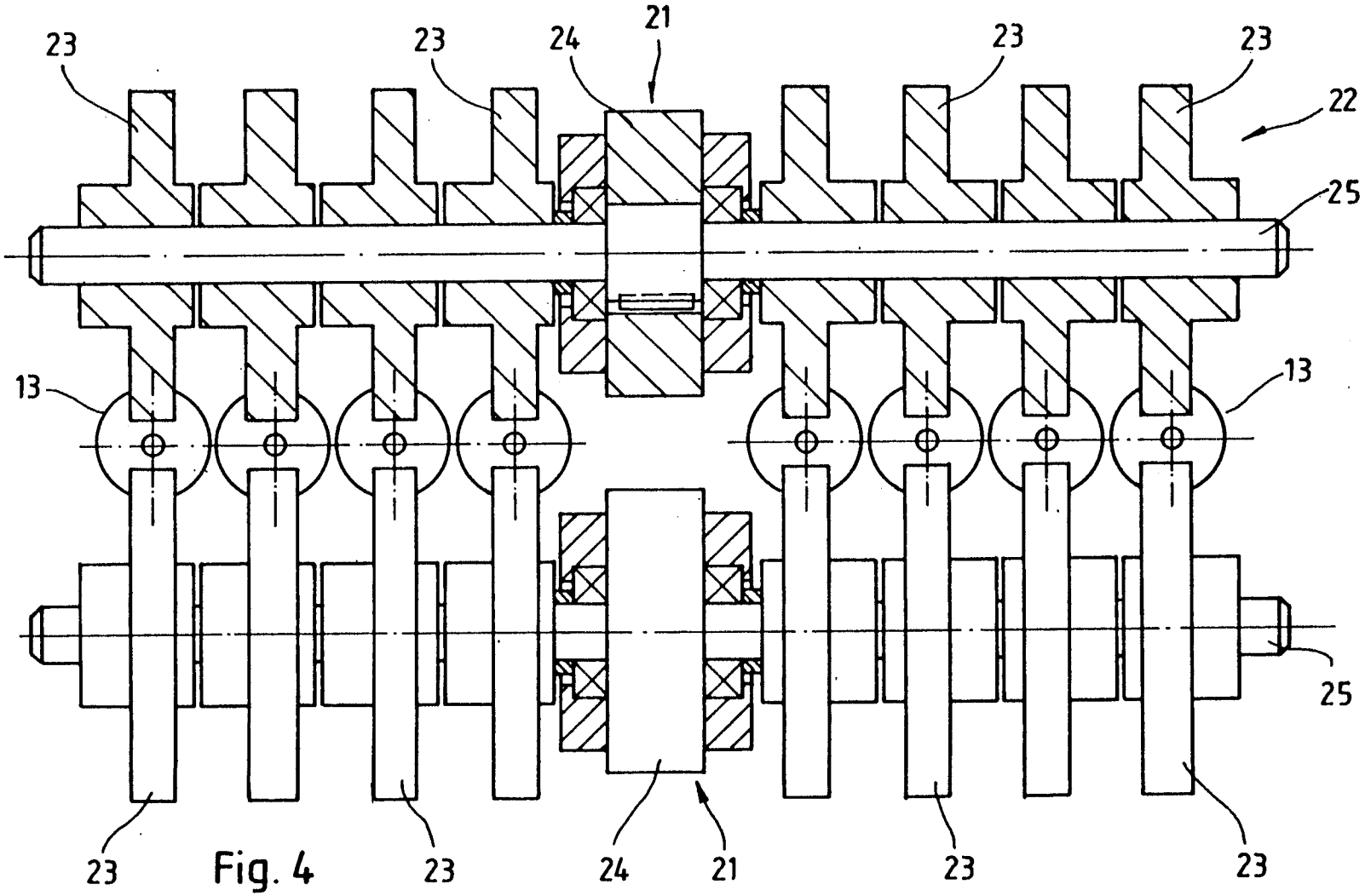
FIG. 4 a view of a feed or draw-in unit seen in the conveying direction.

With each group of guide holes 13 is associated a draw-in or feed unit 22 with a number of friction members 23 corresponding to the number of guide holes in said group. There are in all eight guide holes 13 in the embodiment of FIG. 4.

Figure 5:
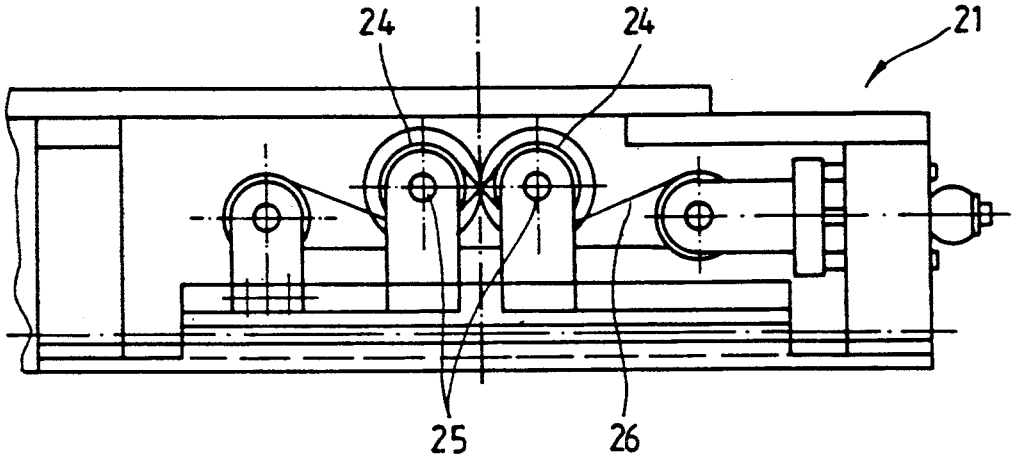
FIG. 5 a front view of a drive unit according to FIG. 3.

The feed unit comprise pairwise positioned friction members 23, which are located on a common spindle 25 and which are driven from the center by a belt pulley 24, which forms part of the drive unit (FIG. 5). With each pair of friction members is associated a guide hole 13 and grips with the facing top surfaces the strand portion at diametrical points. The friction members 23 can e.g. be constructed as rotating brushes.

A synchronous rotation of the pairwise arranged friction members 23 is, as shown in FIG. 5, brought about in that the belt pulleys 24 are so enveloped by a common driving belt 26 that they revolve in opposite directions to one another. They ensure that all the strand portions are supplied at the same speed to the cutting plate or the rotating cutting blades 15. Therefore, the cut length can be modified by varying the feed speed produced by the rotating friction members 23 and/or the rotational speed of rotor 14.

Figure 6:
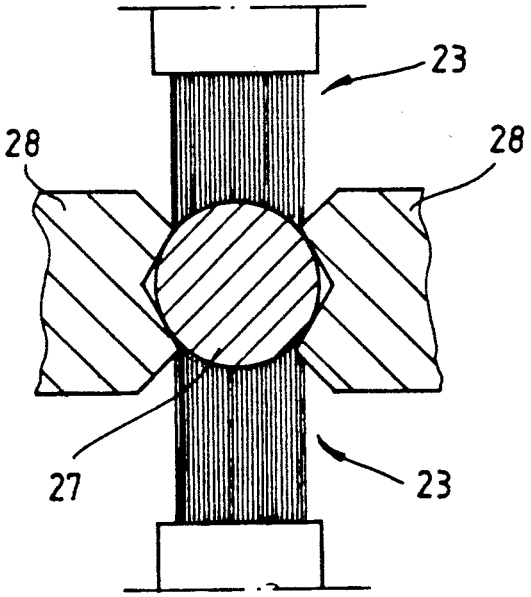
FIG. 6 a larger-scale detail view relative to FIG. 4

FIG. 6 shows a larger scale view of a pair of friction members 23 in the form of brush rollers between which is conveyed the strand portion 27. In order to avoid a lateral escape of the strand portion 27, prismatic guides 28 are arranged laterally on the brush rollers and the strand portion only engages linearly thereon. These prismatic guides extend from the end of guides 10 (FIG. 1) to the cutting plate 12.

We claim:

1. Process for producing propellant charge granular material from small diameter propellant charge strands, whereof a plurality is continuously extruded, separately placed on a support behind an extruder and are supplied by means of the latter to a cutting plate with revolving cutting blades positioned behind it and by which they are cut to length, characterized in that the support forms a setting zone for the propellant strands and that the latter are transferred by the support to a sloping zone and on the latter are supplied to the cutting plate with a number of guide holes corresponding to the number of stands and on passing out of the guide holes are simultaneously cut to the desired short length the cutting blades rotating behind the cutting plate.

2. Process according to claim 1, characterized in that after leaving the extruder, the propellant strands are cut to strand portions having a length which is a multiple of a desired cut length.

3. Process according to one of claims 1 or 2, characterized in that at an end of the sloping zone, the strand portions are introduced into the guide holes of the cutting plate by frictional forces acting in a substantially axially parallel manner on a circumference thereof.

4. Process according to claim 3 characterized in than an angle of slope of the sloping zone in adjustable so that a weight of the strand and friction between the strand and the support are just in balance.

5. A process for producing propellant charge granular material from small diameter propellant charge strands, the process comprising the steps of:

continuously extruding a plurality of small diameter propellant charge strands by an extruder, forming a setting zone for the extruder propellant charge strands by separately placing the extruded propellant charge strands on a support and transporting the extruded propellant charge strands by the support, transferring the extruded propellant charge strands from the support to a sloping zone so that the extruded propellant charges are advanced through the sloping zone substantially by the weight of the extruded propellant charges, guiding the extruded propellant charges through the sloping zone through guides to a cutting plate of cutter means including guide holes corresponding in number to a number of the extruded propellant charge strands, and simultaneously cutting the extruded propellant charge strands passing through the guide holes of the cutter means by revolving cutting blades disposed behind the cutter plate, as viewed in an advancing direction of the extruded propellant charge strands.

6. Process according to claim 5, further comprising the step of cutting the propellant strands after leaving the extruder to a length which is a multiple of the desired cut length.

7. Process according to claim 5, further comprising the step of applying frictional forces acting in a substantially axially parallel manner on a circumference of the extruded propellant charge strands so as to introduce the same into the respective guide holes.

8. Process according to claim 5, further comprising the step of adjusting a slope of the sloping zone so as to obtain a balance between a weight of the extruded propellant charge strands and frictional forces acting thereon.

* * * * *